US007494383B2

(12) United States Patent
Cohen et al.

(10) Patent No.: US 7,494,383 B2
(45) Date of Patent: Feb. 24, 2009

(54) ADAPTER FOR INTERCONNECTING ELECTRICAL ASSEMBLIES

(75) Inventors: Thomas S. Cohen, New Boston, NH (US); David Manter, Windham, NH (US)

(73) Assignee: Amphenol Corporation, Nashua, NH (US)

( * ) Notice: Subject to any disclaimer, the term of this patent is extended or adjusted under 35 U.S.C. 154(b) by 0 days.

(21) Appl. No.: 11/880,679

(22) Filed: Jul. 23, 2007

(65) Prior Publication Data

US 2009/0029602 A1 Jan. 29, 2009

(51) Int. Cl.
*H01R 9/09* (2006.01)

(52) U.S. Cl. ..... 439/638; 439/660; 439/76.1

(58) Field of Classification Search ..... 439/638, 439/660, 76.1, 620.07, 620.05, 620.06
See application file for complete search history.

(56) References Cited

U.S. PATENT DOCUMENTS 6,293,827 B1 * 9/2001 Stokoe ..... 439/608
6,343,957 B1 * 2/2002 Kuo et al. ..... 439/638
6,364,713 B1 * 4/2002 Kuo ..... 439/638
6,722,897 B1 * 4/2004 Wu ..... 439/76.1
6,776,659 B1 * 8/2004 Stokoe et al. ..... 439/608
6,786,771 B2 * 9/2004 Gailus ..... 439/608
6,830,483 B1 * 12/2004 Wu ..... 439/638
7,163,421 B1 * 1/2007 Cohen et al. ..... 439/608
2004/0072473 A1 * 4/2004 Wu ..... 439/638
2006/0068640 A1 * 3/2006 Gailus ..... 439/608

* cited by examiner

*Primary Examiner*—Gary F. Pauman
(74) *Attorney, Agent, or Firm*—Wolf, Greenfield & Sacks, P.C.

(57) ABSTRACT

An electrical connector suitable for use in an adapter. The connector includes conductive elements that can be routed in three dimensions to facilitate interconnections between connectors used to form an adapter. Simplified construction is achieved through use of connector wafers, each of which route signals in a plane such that when the wafers are organized side-by-side in a connector, signals may be routed through multiple parallel planes. Some of the wafers may include holes through which conductive elements from other wafers may pass, to that signal may be routed in a third dimension, perpendicular to the parallel planes. The adapter may be mounted on a printed circuit board or other substrate with active components. Signals may pass through the adapter in one of the parallel planes or may be routed for conditioning in the active components.

18 Claims, 13 Drawing Sheets

ADAPTER FOR INTERCONNECTING ELECTRICAL ASSEMBLIES

BACKGROUND OF INVENTION

1. Field of Invention

This invention relates generally to electrical interconnection systems.

2. Discussion of Related Art

Electrical connectors are used in electronic systems to form connections between assemblies that are manufactured separately but exchange signals during operation. Frequently, the assemblies are formed with printed circuit boards ("PCBs"), each of which includes a connecter that mates with a complementary connecter on another one of the PCBs. A frequently used arrangement for interconnecting multiple PCBs is to have one PCB serve as a backplane. Other PCBs, which are called "daughter boards" or "daughter cards," are then connected through the backplane by mating electrical connectors that intersect the backplane at a right angle, allowing connectors on the daughter boards to be inserted into connectors on the backplane. For this reason, the connectors used to connect daughter boards to a backplane are sometimes called "right angle connectors" or "backplane connectors." Similar connectors may be used in electronic systems with midplanes to which daughter boards may be attached on two sides or in other systems in which boards intersect at a right angle.

Electrical connectors may also be used to join PCB's in other configurations. Some electronic systems include a "mother board," which contains a processor or other electronic components. Components that interact with components on the mother board may be attached to a daughter board, which is frequently mounted parallel to the mother board. "Stacker" or "mezzanine" connectors may be used to join the boards in this configuration.

Other types of connectors may be used to join other types of assemblies. For example, cables, with cable connectors at one or both ends, may be used to join assemblies that do not directly intersect.

Regardless of the specific application, electronic assemblies frequently have connectors shaped to mate with connectors on other assemblies. When the connectors on the assemblies are mated, conducting paths are completed through the connectors, providing electrical connections between the assemblies. However, in some instances, subassemblies for which connections are desired may not have connectors configured to mate with each other. In this scenario, an adapter may be used.

An adapter may be an assembly with two or more connectors. One of the connectors may mate with a connector on one of the assemblies to be joined, and another connector on the adaptor may mate with a connector on another of the assemblies. The adapter may provide conducting paths between the two connectors so that points on one assembly that are connected to one of the connectors of the adapter are appropriately connected to points on the other assembly that are connected to the other connector of the adapter.

In some systems, merely routing signals from one connector of the adapter to another is not adequate to ensure proper functioning of the assemblies. For example, one assembly may output signals of a different type or in a different form than is required at the input of the other assembly. Accordingly, adapters may include components that modify signals as they pass through the adapter to ensure that each assembly receives signals in an appropriate form.

Regardless of the specific application of electrical connectors, a connector should have electrical and mechanical properties appropriate for the system in which it will be used. One of the difficulties in making a connector is that electrical conductors in the connector can be so close that there can be electrical interference between adjacent signal conductors. To reduce interference, and to otherwise provide desirable electrical properties, metal members are often placed between or around adjacent signal conductors. The metal acts as a shield to prevent signals carried on one conductor from creating "crosstalk" on another conductor. The metal also impacts the impedance of each conductor, which can further contribute to desirable electrical properties.

As signal frequencies increase, there is a greater possibility of electrical noise being generated in the connector in forms such as reflections, crosstalk and electromagnetic radiation. Therefore, electrical connectors for higher speed signals are designed to limit crosstalk between different signal paths and to control the characteristic impedance of each signal path. Shield members are often placed adjacent signal conductors in a connector for this purpose.

Although shields for isolating conductors from one another are typically made from metal components, U.S. Pat. No. 6,709,294 (the '294 patent), which is assigned to the same assignee as the present application and which is hereby incorporated by reference in its entirety, describes making an extension of a shield plate in a connector from conductive plastic. U.S. Published Application 2006/0068640 and U.S. Pat. No. 7,163,421, which are assigned to the assignee of the present invention and which are hereby incorporated by reference in their entireties, also describe the use of lossy material to improve connector performance.

Electrical characteristics of a connector may also be controlled through the use of absorptive material. U.S. Pat. No. 6,786,771, (the '771 patent), which is assigned to the assignee of the present application and which is hereby incorporated by reference in its entirety, describes the use of absorptive material to reduce unwanted resonances and improve connector performance, particularly at high speeds (for example, signal frequencies of 1 GHz or greater, particularly above 3 GHz).

Other techniques may be used to control the performance of a connector. Transmitting signals differentially can also reduce crosstalk. Differential signals are carried by a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

Examples of differential electrical connectors are shown in U.S. Pat. No. 6,293,827 (the '827 patent) and U.S. Pat. No. 6,776,659 (the '659 patent), which are assigned to the assignee of the present application. Both the '827 patent and the '659 patent are hereby incorporated by reference in their entireties.

SUMMARY OF INVENTION

The invention relates to an electrical connector design and an adapter that can be formed with connectors of that design.

In one aspect, the invention relates to a connector assembly that has conductive elements oriented in three dimensions. Three dimensional conductive elements may facilitate interconnections between connectors or interconnections of points on the connector to signal or power conditioning circuitry, which may facilitate design of an adapter. Accordingly, in some embodiments of the invention, an electrical connector includes two or more subassemblies. A first subassembly has a first housing and a first plurality of conductive members, each of which has a portion disposed within the first housing in a first plane. The first housing has at least one hole perpendicular to the first plane. A second subassembly includes a second housing with a second plurality of conductive members, each of which has a portion disposed within the second housing in a second plane. The second plane is parallel to the first plane. Some of the second plurality of conductive members extend from the second housing and through holes in the first housing.

In another aspect, the invention relates to an electrical connector with a plurality of subassemblies. A first subassembly includes a first plurality of conductive members embedded in a first housing. A second subassembly has a second plurality of conductive members embedded in a second housing. At least one of the second plurality of conductive members has a portion extending from the second housing and passing through the first housing.

In yet a further aspect, the invention relates to an electrical connector with a plurality of subassemblies. A first subassembly includes a first plurality of conductive members, each which has a first end and a second end. At least a first subset of the first plurality of conductive members has a mating contact at each of the first end and the second end, with the mating contacts at the first ends being aligned in a first row and the mating contacts at the second ends being aligned in a second row, parallel to the first row. A first insulating housing is molded around at least a portion of each of the first plurality of conductive members. A second subassembly includes a second plurality of conductive members, each of which has a first end and a second end. At least a second subset of the second plurality of conductive members has a mating contact at each of the first end and the second end, with the mating contacts at the first ends being aligned in a third row and the mating contact s at the second ends being aligned in a fourth row, parallel to the third row. A second insulating housing is molded around at least a portion of each of the second plurality of conductive members.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
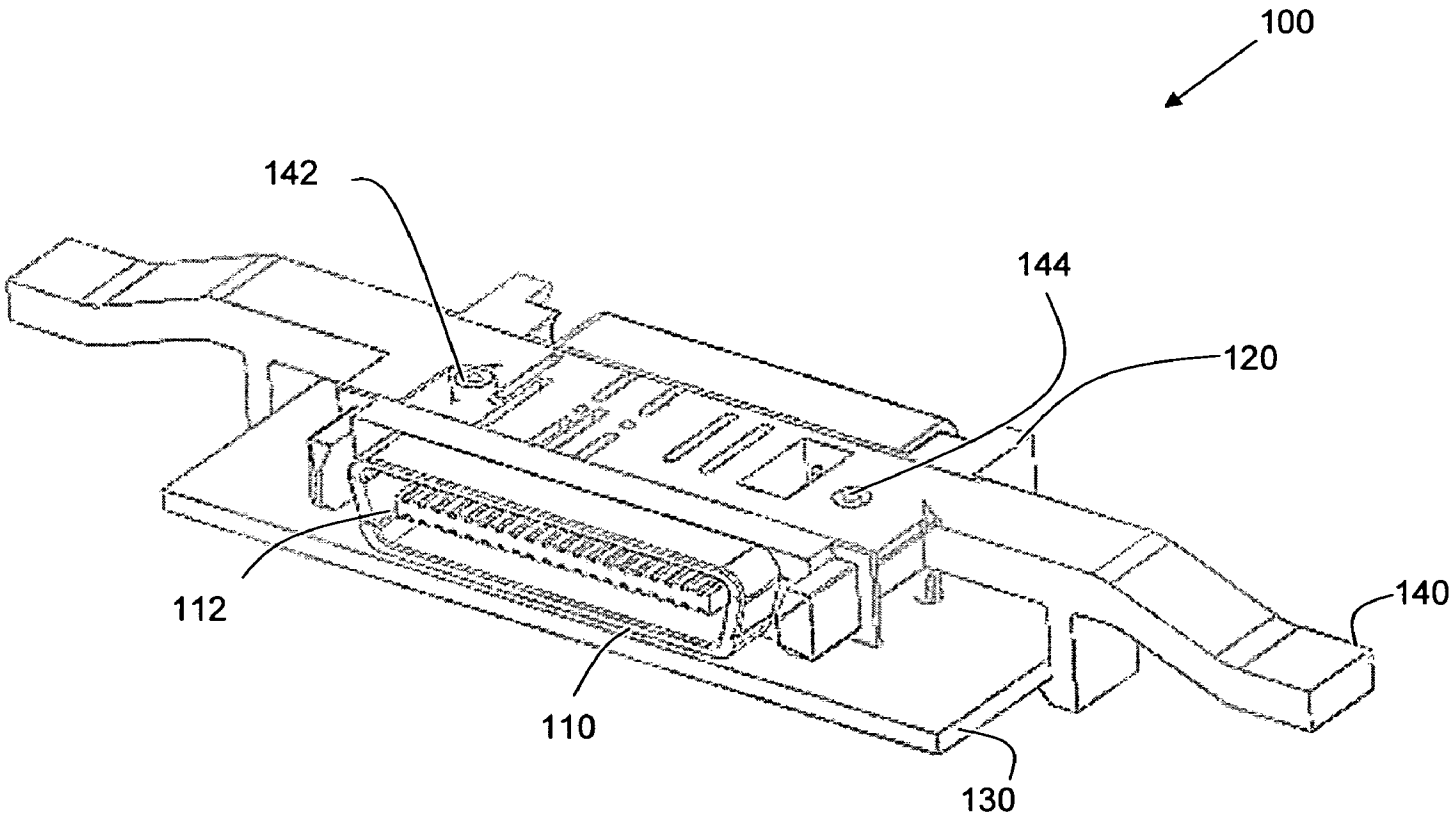
FIG. 1 is a sketch of an adapter for interconnecting electrical assemblies according to an embodiment of the invention.

An adapter using connectors according to an embodiment of the invention is illustrated in FIGS. 1-13. In the embodiment illustrated, the adapter is constructed from wafers, each of which contains multiple conductive elements arrayed in a plane. The wafers are aligned in a side-by-side configuration, positioning the conductive elements in multiple parallel planes.

The conductive elements of each wafer extend from a housing for the wafer. The extending portions of the conductive elements may be shaped as mating contacts. Mating contacts extending from the housings can be captured in insulating caps to form electrical connectors. In the embodiments illustrated, the conductive elements extend from two edges of the wafers, creating an adapter with connectors on two sides.

The planar configuration of the wafers allows signals to be readily routed through the adaptor from one connector to another. To allow signals or power passing through the adapter to be modified, the wafers may be constructed such that signals entering the adapter in one of the parallel planes may be routed perpendicularly to the planes to engage a substrate, such as a printed circuit board, containing components. The components may be arranged to process signals or condition power levels within the adapter.

In the drawings, the invention is illustrated in conjunction with an adapter having two parallel planes containing conductive elements ending in two complementary connectors on opposite sides of the adapter. However, the invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

FIG. 1 illustrates an adapter 100 according to an embodiment of the invention. Adapter 100 includes a first connector 110 and a second connector 120. Such an adapter may be used in an electronic system to interconnect two assemblies having connectors that are not designed to mate with each other. Alternately, such an adapter may be used to connect two assemblies that have connectors that are physically compatible, but that operate with incompatible signal formats or power levels, requiring an adapter to process signals or condition power passing through the adapter.

Regardless of why the assemblies are joined through an adapter, connector 110 may be configured to mate with a connector of one of the assemblies, and connector 120 may be configured to mate with a connector of another of the assemblies. Adapter 100 may be constructed to provide conducting paths between connectors 110 and 120, so that signals and power may be appropriately routed and conditioned within adapter 100. As a result, outputs of the first assembly, after passing through adapter 100, are appropriate for inputs to the second assembly, and vice-versa.

As an example, adapter 100 may be used in a computer system to connect a disk drive (not shown) or other component to a system bus (not shown) to which the disk drive is not designed to directly interface. The disk drive may have a connector that is mechanically incompatible with a connector to the system bus. Alternatively or additionally, the disk drive may be electrically incompatible with the system bus. For example, a disk drive may operate at different voltage levels than are available over the system bus, may employ signals with different formats than are communicated over the system bus or may have a connector pin out with signal placements that do not match those on a connector to the system bus. Adapter 100 may provide conducting paths between connectors 110 and 120 and may process signals or condition power conveyed on those paths to address any electrical or mechanical incompatibilities between the disk drive and the system bus. However, the type of assemblies connected through adapter 100 and the nature of the incompatibilities between those assemblies are not limitations on the invention, and any suitable assemblies may be interconnected using an adapter according to embodiments of the invention.

Adapter 100 includes conductive elements that pass between connector 110 and connector 120. Mating contact 112, forming a portion of connector 110, may be at one end of a conductive element. Other mating contacts (not numbered) may similarly be at ends of other conductive elements. Some or all of these conductive elements may have a second end that forms a mating contact (not visible in FIG. 1) of connector 120. Such conductive elements may be used to route signals or power between assemblies without processing or other conditioning.

Additionally, adapter 100 may include components that can provide signal processing or power conditioning when desired. In the embodiment illustrated, the components may be mounted on a substrate, such as printed circuit board 130. To provide conditioning, some of the conductive elements that form mating contacts 112 within connector 110, may have an end connected to printed circuit board 130. Likewise, some of the conductive elements that form mating contacts of connector 120 may also be routed to printed circuit board 130. In this way, components, including active components, on printed circuit board 130 may condition power or process signals passing between connector 110 and connector 120.

In the embodiment illustrated, adapter 100 is formed of multiple components. The components may be held together in any suitable way. In the embodiment illustrated, a bracket 140 provides mechanical support for the components of adapter 100. In the embodiment illustrated, pins 142 and 144 pass through bracket 140 and other components of adapter 100. Through the interaction of bracket 140 and pins 142 and 144, the components of adapter 100 may be held together. However, any suitable mechanism to hold the components of adapter 100 may be used. For example, support members in other shapes may be used in some embodiments, while in other embodiments epoxy or other adhesive materials may be used. Further, in some embodiments, snap-fit, interference fit or other types of attachment mechanisms may be used to hold the components together. Accordingly, the specific form of attachment used is not a limitation on the invention.

Figure 2:
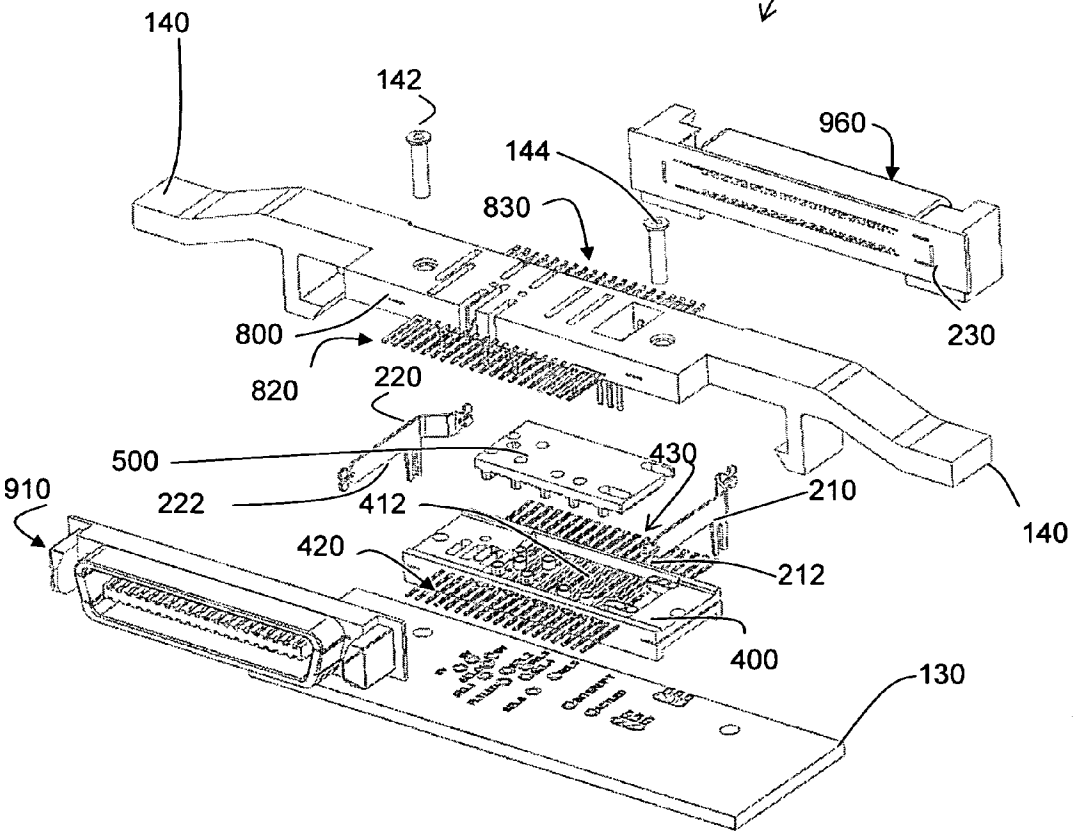
FIG. 2 is an exploded view of the adapter of FIG. 1.

FIG. 2 shows adapter 100 partially exploded. In the embodiment of FIG. 2, adapter 100 is formed with two wafers 400 and 800, which are stacked side-by-side. Further details of wafers 400 and 800 are shown in conjunction with FIGS. 4 and 8, respectively. Wafer 400 includes a lossy insert 500, which is described in greater detail in conjunction with FIG. 5, below.

In the embodiment illustrated, pins 142 and 144 pass through bracket 140, wafer 800, wafer 400 and printed circuit board 130, securing the components together. Pins 140 and 142 may be secured in any suitable fashion. For example, pins 140 and 142 may be secured by riveting, welding or in any other suitable way.

Conductive elements may extend from wafers 400 and 800 where connectors are formed. The extending ends may form mating contacts for the connectors. In the embodiment illustrated, adapter 100 includes two connectors and conductive elements extend from two sides of wafer 400, forming row 420 and row 430 of mating contacts. Conductive elements likewise extend from wafer 800, forming rows 820 and 830 of mating contacts. Accordingly, in the embodiment illustrated, each of connectors 110 and 120 (FIG. 1) contains two rows of mating contacts.

Separate components may provide housings for the mating faces of the connectors. In the example of FIG. 2, cap 910 fits over rows 420 and 820, forming connector 110 (FIG. 1). Cap 910 may be made of an insulating material, such as plastic. Rows 430 and 830 extending from wafers 400 and 800, respectively, are inserted into cap 960 to form connector 120 (FIG. 1). Cap 960 also may be formed of an insulating material and may secure the mating contacts of rows 430 and 830 to form connector 120 (FIG. 1). Cap 960, like cap 910, may be made of plastic or other suitable material.

Caps 910 and 960 may be secured to adapter 100 in any suitable way. In the embodiment illustrated, latch members 210 and 220 may be used to secure caps 910 and 960. Alternatively, pins, screws, adhesive or other suitable attachment mechanisms may be used to secure caps 910 and 960. Latch members 210 and 220 may be incorporated into adapter 100 in any suitable way. For example, latch members 210 and 220 may be held between bracket 140 and another component of adapter 100, such as wafer 400 and/or wafer 800. Alternatively, wafer 400 and/or wafer 800 may include slots shaped to receive latch members 210 and 220.

Regardless of how latch members 210 and 220 are secured, each of latch members 210 and 220 has latch ends extending toward caps 910 and 960. In the configuration illustrated in FIG. 2, latch ends 212 and 222, extending toward cap 910, are visible. Similar latch ends (not numbered) extend toward cap 960. Each of the latch ends may include a flexible member or members that engage a complementary latching feature in one of caps 910 and 960.

In the configuration illustrated in FIG. 2, slot 230, visible in cap 960, forms a portion of a complementary latching feature. Slot 230 may provide an opening to a cavity that is larger than the opening itself. As a result, a lip may be formed around the inside of slot 230. As a latch end of latch member 210 is pressed into slot 230, the latch end is compressed, allowing the latch end to pass through slot 230. Because a latch end may include springy or compliant members, once the latch end is pressed through slot 230, it may expand and engage a lip around slot 230. Accordingly, when cap 960 is pressed toward the rest of adapter 100 including latch member 210, a latch end of latch member 210 may latch within slot 230. Latch end 212 may engage a similar slot in cap 910. Latch end 222 of latch member 220 may likewise engage a slot, or other latching feature, in cap 910. A second latch end of latch member 220 may similarly engage a slot, or other latching feature, of cap 960.

Any suitable materials and manufacturing techniques may be used to form the components of adapter 100. For example, bracket 140 may be metal formed by molding or extrusion or in any other suitable way. In other embodiments, bracket 140 may be formed of plastic or other suitable material. Pins 142 and 144 may also be formed of metal, plastic or other suitable material.

Latch members 210 and 220 may be formed of a compliant material, including plastic or a sheet of metal and may be formed by molding, stamping or other suitable techniques. Caps 910 and 960 may also be molded of plastic or other insulating material, through parts of caps 910 and 960 could be conductive or partially conductive. Wafers 400 and 800 may be made by insert molding, through any suitable construction technique may be used.

Similarly, a substrate such as PCB 130 may be formed in any suitable way. It may include a combination of passive and active components that process signals, condition power or perform any other desired functions.

Figure 3:
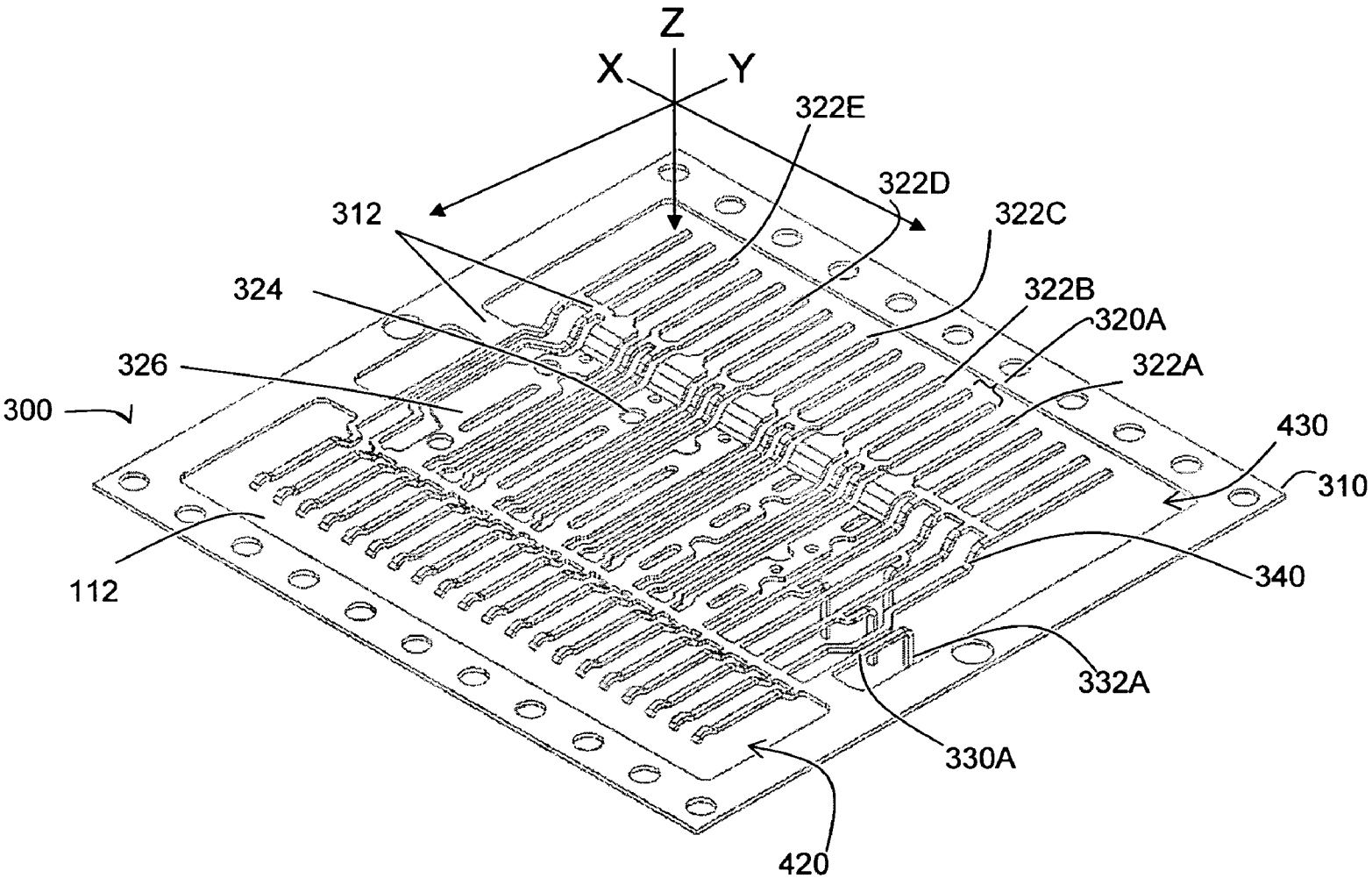
FIG. 3 is a sketch of a lead frame used in the construction of the adapter of FIG. 1.

Turning to FIG. 3, a lead frame 300 used in the manufacture of wafer 400 is illustrated. In the embodiment illustrated, lead frame 300 is one of two lead frames in adapter 100. However, any number of lead frames may be used and in some embodiments three or more lead frames may be incorporated into adapter 100. Lead frame 300 may be made of any suitable conductive material. In the embodiment illustrated, lead frame 300 is stamped from a sheet of relatively springy metal, such as phosphor-bronze. However, other copper alloys, such as beryllium-copper, or any other suitable material may alternatively be used. In the embodiment illustrated, lead frame 300 contains multiple conductive elements held generally in the plane labeled X-Y. The conductive elements may be made by stamping and forming conductive elements of a desired shape.

Three types of conductive elements are shown in the example of FIG. 3: high speed signal conductors, ground conductors and low speed signal conductors. In the embodiments illustrated, high speed signals pass through adapter 100 as differential signals. Differential signals are carried on pairs of conductors, such as pair 320A.

Ground conductors may also be included. In the embodiment illustrated, ground conductors, such as ground conductors 322A and 322B are wider than the conductors forming differential pairs, such as pair 320A, and wider than the conductors carrying low speed signals. The wide ground conductors may provide a low inductance path for ground current to flow through adapter 100. Additionally, the ground conductors are positioned between adjacent pairs of high speed differential conductors. With this configuration, the ground conductors may reduce cross-talk between high speed signals. In the embodiment illustrated, each of the differential pairs is between two adjacent ground conductors. For example, signal pair 320A is between ground conductors 322A and 322B.

Low speed signal conductors also traverse the X-Y plane between rows 420 and 430 of mating contacts. For example, low speed signal conductor 340 traverses the X-Y plane between row 420 and row 430. Conductive members for low speed signals may be narrower than ground conductors and may be the same width as high speed signal conductors. Though, in some embodiments the low speed and high speed signal conductors may have different widths. In the embodiment illustrated, low speed signal conductors can be distinguished from high speed because the low speed signed conductors are not grouped in pairs designed for preferential coupling with each pair separated by a ground conductor. However, any suitable shape for a low speed signal conductor may be used.

In use, data, such as data being read from a disk drive at a high speed, may be communicated through adapter 100 on a signal pair, such as pair 320A. Lower speed signals, including control signals and DC levels that carry power through adapter 100, may be routed on low speed signal conductors, such as conductor 340. In some instances, conditioning or other processing may be desired for low speed signals. Such conditioning may be provided by components on a substrate below the X-Y plane.

Accordingly, lead frame 300 is shown with some low speed signal conductors, such as low speed signal conductor 330A, having perpendicular portions, such as perpendicular portion 332A. Perpendicular portion 332A extends out of the X-Y plane in the Z direction. When lead frame 300 is assembled into an adapter such as adapter 100 (FIG. 1), the conductive elements extending in the X-Y plane couple signal or power levels between connectors 110 and 120. Perpendicular portions extending in the Z direction may couple a conductive element to printed circuit board 130 or other component for processing.

The individual conductive elements within lead frame 300 may be held to carrier strip 310 with multiple tie bars, of which tie bars 312 are numbered. In the pictured embodiment, lead frame 300 may be over molded with an insulating housing. In a finished adapter, the insulating housing may hold the individual conductive elements in place. Once the conductive elements are held by a housing, the tie bars 312 may be severed at any suitable time, electrically isolating the individual conductive members within lead frame 300.

Figure 4:
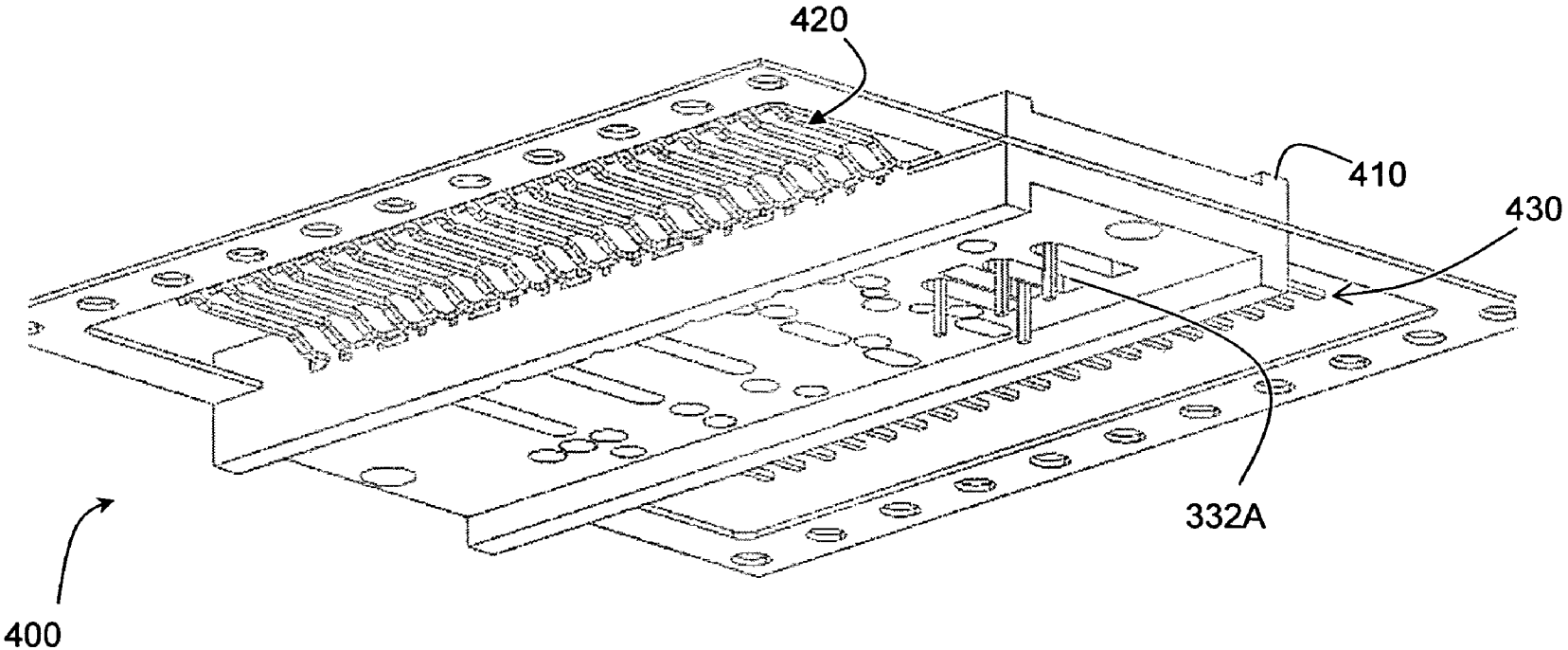
FIG. 4 is a sketch of a wafer incorporating the lead frame of FIG. 3.

FIG. 4 shows portions of the conductive elements in lead frame 300 secured within a housing 410 of a wafer 400. In the embodiment illustrated, housing 410 is formed of an insulating material, such as plastic. Wafer 400 may be made in any suitable way. In the embodiment illustrated, wafer 400 may be made by molding housing 410 around lead frame 300 (FIG. 3) using an insert molding operation. However, housing 410 may be formed with channels, grooves or other features adapted to receive conductive members of lead frame 300, which may be inserted in housing 410 after it is formed. Accordingly, the method of construction of wafer 400 is not a limitation of the invention.

As can be seen in FIG. 4, conductive elements extend from opposite sides of housing 410, forming rows 420 and 430. Perpendicular portions (of which perpendicular portions 332A is numbered), extend from the lower surface of housing 410. With this configuration, rows 420 and 430 are positioned to form mating contacts of connectors 110 and 120 (FIG. 1) and perpendicular portions are positioned to engage printed circuit board 130 (FIG. 1). However, mating contacts and portions adapted to engage a substrate may extend from any suitable surface of a wafer.

In the embodiment of FIG. 4, the portions of the conductive members extending in rows 420 and 430 are shaped to form mating contacts of connectors 110 and 120, respectively. In the embodiment illustrated, the rows of mating contacts extending from opposite sides of wafer 400 have complementary configurations. The mating contact portions in row 420 are shaped as compliant beams. Conversely, the mating contact portions in row 430 are shaped as blades. A mating contact shaped as a beam may mate with a mating contact shaped with a blade. Though the shape of the mating contact portions is not a limitation on the invention, this configuration allows adapter 100 to be inserted between two assemblies with connectors that may otherwise be shaped to mate. In other embodiments, complementary mating contacts of other shapes may be used. In yet other embodiments, mating contacts extending from opposite surfaces of wafer 400 may not be complementary.

The perpendicular portions extending from the lower surface of the housing 410 may have any suitable configuration that engages a substrate, such as printed circuit board 130 (FIG. 1). For example, the perpendicular portions may be shaped as contact tails for engaging a printed circuit board. In some embodiments, the contact tails may be configured for soldering to a printed circuit board, using through hole or surface mount techniques. In other embodiments, the projecting portions may have press-fit compliant sections or may be shaped for connection to a printed circuit board in any other suitable way.

Housing 410 may be molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. Some such materials may also act as a binder for one or more fillers included in housing 410 to control the electrical or mechanical properties of housing 410. For example, thermoplastic PPS filled to 30% by volume with glass fiber may be used to form housing 410. These materials may also be used to form other insulating components of adapter 100. The integrity with which high speed signals are propagated through wafer 400 may be improved through the incorporation of electrically lossy material into housing 410. In the embodiment illustrated, the electrically lossy material is positioned along the wide portions of the ground conductors 322A . . . 322E (FIG. 3) embedded within housing 410. Lossy material in these locations may reduce the effect of interference on the high speed signal conductors, such as differential signal pair 320A (FIG. 3) without causing an undesirable amount of loss to high speed signals carried on those signal pairs. However, the amount and placement of the lossy material is not a limitation of the invention.

Lossy material may be incorporated into housing 410 in any suitable way. In some embodiments, the lossy material may be incorporated into housing 410 as part of a two-shot molding operation. In other embodiment, the lossy material may be formed as part of a separate component that is inserted into an insulating portion of housing 410 after the insulating portion is formed.

Figure 5:
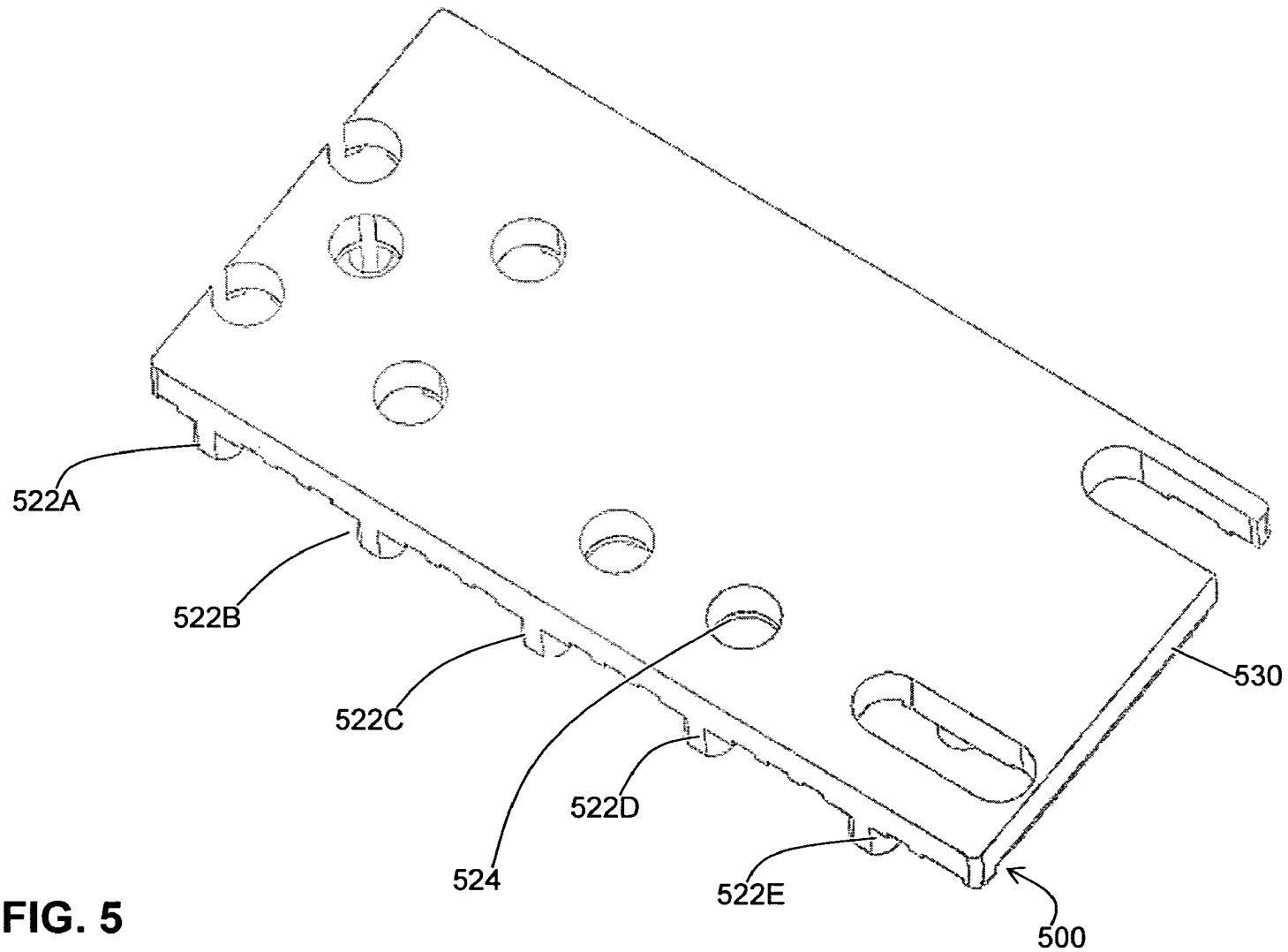
FIG. 5 is a sketch of a partially lossy insert used in the wafer of FIG. 4.

FIG. 5 illustrates an insert 500 that may be wholly or partially formed of lossy material. Insert 500 may be inserted into a cavity in housing 410 or otherwise incorporated into a wafer 400 in any suitable way.

In the embodiment illustrated, insert 500 is partially formed of lossy material in a two-shot molding operation. Insert 500 includes a generally planar portion 530, which, in the embodiment illustrated, is formed of an insulating material. Projections, such as projections 522A . . . , 522E extend from planar portion 530. In the embodiment illustrated, projections 522A . . . , 522E are positioned to align with wide portions of ground conductors 322A . . . 322E (FIG. 3) when insert 500 is inserted into insulating housing 410 (FIG. 4). This placement of lossy material has been found to reduce both near and far end cross-talk and to also reduce both insertion loss and return loss over a frequency range spanning between about 1 GHz and 10 GHz. However, specific placement of lossy material is not a limitation of the invention and lossy material may be positioned in any suitable location or, in some embodiments, may be omitted.

Any suitable lossy material may be used. In one embodiment, the lossy material may include a thermoplastic material filled with conducting particles. The fillers make the portion "electrically lossy." Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 11/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, conductive particles disposed in the lossy projections 522A . . . 522E of the housing may be disposed generally evenly throughout, rendering a conductivity of the lossy portion generally constant. In other embodiments, a first region of the lossy projections 522A . . . 522E may be more conductive than a second region of the lossy projections 522A . . . 522E so that the conductivity, and therefore amount of loss within the lossy projections 522A . . . 522E may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be attached to housing 410 and/or may be positioned to adhere to ground conductors in the wafer 400. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

However, regions of lossy material may be formed in any suitable way. For example, the lossy regions may be formed by plating a partially conductive coating on a substrate, such as the insulating housing. A lossy material region may be formed by plating a lossy material. Alternative, a lossy region may be formed by plating a relatively highly conductive material in a relatively dispersed coating to provide a coating with a high resistivity. Though other manufacturing approaches are possible, including by bombarding a base material with molecules to change the loss properties of the base material.

Insert 500 may be formed with holes or other openings that allow conductive elements from other wafers in adapter 100 to pass through wafer 400. FIG. 5 shows a hole 524 positioned to align with hole 324 in a ground conductor 322D (FIG. 3). With this configuration, a conductive element with a perpendicular portion may extend from wafer 800 (FIG. 2) through insert 500. The perpendicular portion may pass through a corresponding hole in insulating housing 410 and through hole 324 in ground conductor 322D. In this way, a conductive element may pass through wafer 400 in the Z direction.

The number and placement of holes, slots or other openings through wafer 400 is not critical to the invention. FIG. 5 illustrates multiple openings through insert 500. Corresponding openings may be provided through insulating housing 410. Likewise, lead frame 300 may be configured such that conductive elements do not block the openings through the housings through which perpendicular portions extend. One technique to ensure that conductive elements do not block openings in housing portions is to align openings in the conductive members with the openings in the housing portions. Other techniques may entail positioning openings in the housing portions to align with regions of lead frame 300 that does not contain conductive elements. The conductive elements may be jogged, offset or otherwise positioned so as not to align with openings in the housing portions. In the embodiment illustrated, differential signal pairs, such as signal pairs 320A, traverse the X-Y plane in generally straight lines. Accordingly, openings through which perpendicular portions of conductive elements from other wafers pass through lead frame 300 may align with ground conductors and low speed signal conductors, but in the embodiment illustrated, do not pass through a portion of the X-Y plane containing the high speed signal conductors.

Figure 6:
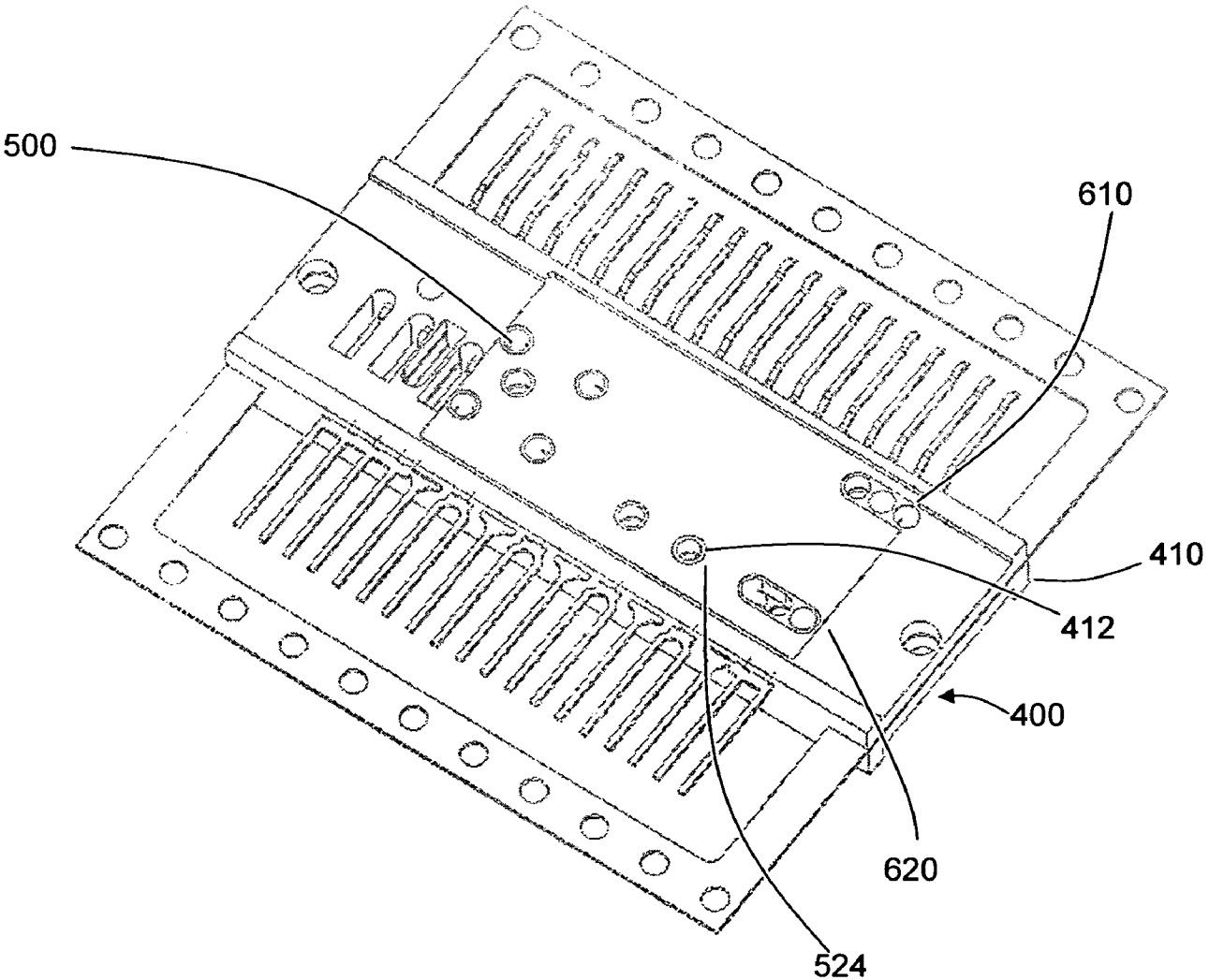
FIG. 6 is a sketch of the wafer of FIG. 4 with the partially lossy insert of FIG. 5 inserted.

FIG. 6 shows a top view of wafer 400 with lossy insert 500 inserted into housing 410. Lossy insert 500 may be secured to insulating housing 410 in any suitable way. The components may be shaped to form an interference fit, a snap fit or other attachment mechanism when pressed together. Alternatively, insert 500 may be secured to insulating housing 410 using adhesive or any other suitable attachment mechanism.

As can be seen in FIG. 6, wafer 400 includes openings through which conductive elements may pass through wafer 400. To avoid shorting conductive elements through partially conducting portions of insert 500, a projection from insulating housing 410 may enter each opening in lossy insert 500. For example, hole 524 through lossy insert 500 surrounds a projection 412 (FIG. 1) of insulating housing 410. Other openings in lossy insert 500 may be similarly aligned with projections from insulating housing 410.

With this configuration, perpendicular portions of conductive elements from one or more other wafers aligned with wafer 400 may pass through wafer 400 to connect with a substrate on which signals may be processed or otherwise conditioned. Other wafers in adapter 100 may be formed using insert molding techniques similar to those used to form wafer 400.

Figure 7:
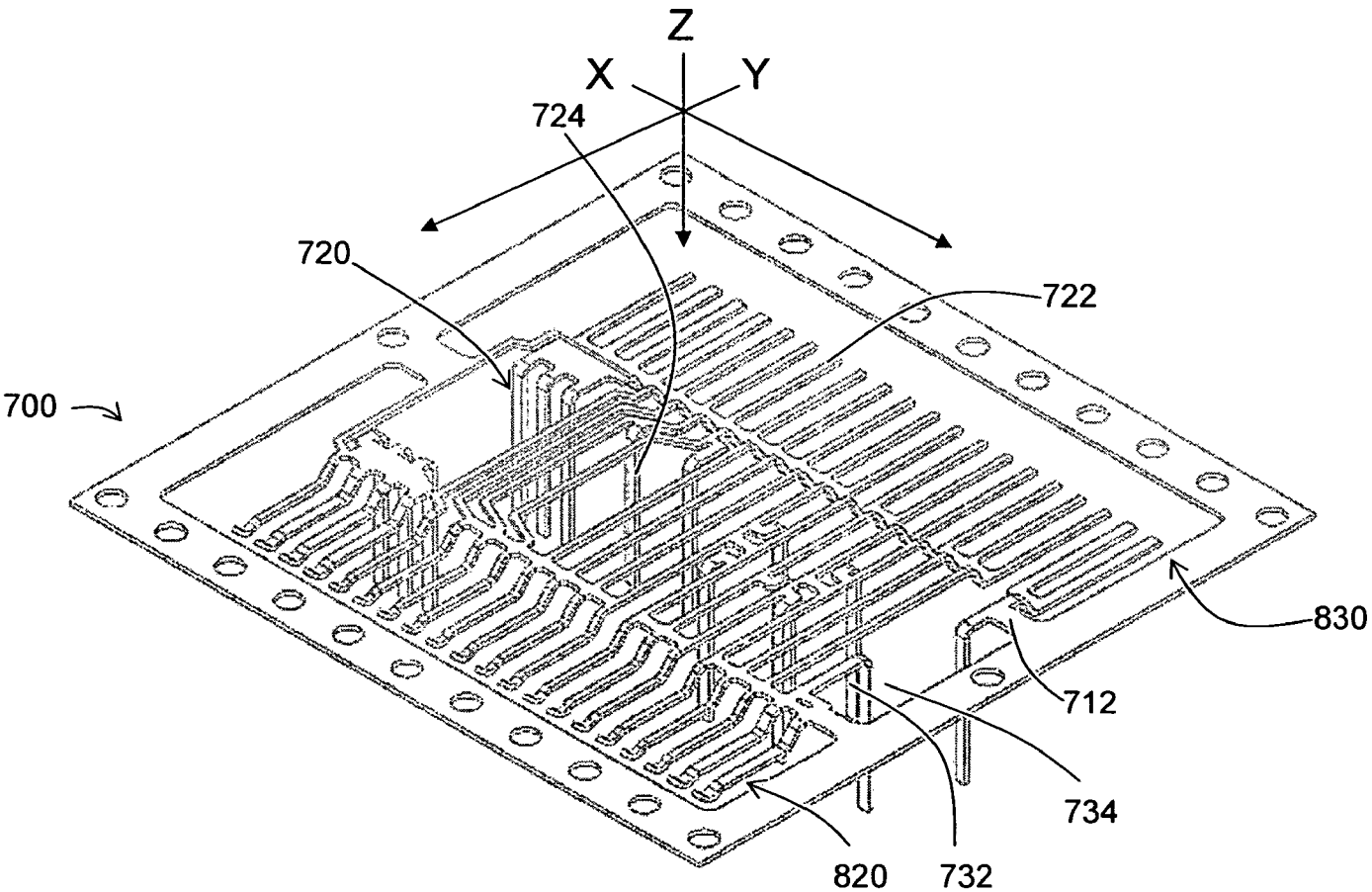
FIG. 7 is a sketch of a second lead frame used in the adapter of FIG. 1.

FIG. 7 illustrates a lead frame 700 that may be used to form wafer 800 (FIG. 2) that may be aligned with wafer 400. As with lead frame 300 (FIG. 3), lead frame 700 may be stamped and formed from a sheet of metal or other suitable material. As shown in FIG. 7, lead frame 700 may include multiple conductive elements aligned in the X-Y plane. The ends of the conductive elements may be shaped to form mating contacts. FIG. 7 shows the conductive elements with a row 820 of beam-shaped mating contacts that may form a row of mating contacts in connector 110 (FIG. 1). The opposite ends of the conductive elements form a row 830 of mating contacts. The mating contacts in row 830 are blade-shaped and may form a row of mating contacts in connector 120 (FIG. 1).

Some of the conductive elements may include perpendicular portions extending in the Z direction. For example, conductive element 722 is shown with perpendicular portion 724. In the embodiment illustrated, the perpendicular portions of the conductive elements in lead frame 700 are positioned to align with openings in wafer 400. For example, perpendicular portion 724 may be aligned with opening 524 in insert 500. Other conductive elements with perpendicular portions may align with other openings in wafer 400. For example, perpendicular portions 720 may be positioned to align with opening 610 (FIG. 6) in wafer 400.

The conductive elements with perpendicular portions may have mating contacts at one or more ends. For example, conductive element 722 is connected to mating contacts in both rows 820 and 830. In contrast, conductive element 732, with perpendicular portion 734, has a mating contact only in row 820. Accordingly, the number of mating contacts connected to each perpendicular portion is not a limitation on the invention.

In the embodiment illustrated in FIG. 7, the conductive elements in lead frame 700 form low speed signal conductors. However, the type of signals carried in each lead frame is not a limitation on the invention. In addition to or instead of low speed signal conductors, lead frame 700 may include signal conductors shaped for carrying differential signals or ground.

As with lead frame 300, lead frame 700 may include tie bars, of which tar bars 712 are numbered, until a suitable point in the manufacture of a wafer 800 at which time the tie bars may be severed to create electrically separate conductive elements. In the embodiment illustrated, the tie bars 712 may be severed after the lead frame 700 is molded in an insulating housing.

Figure 8:
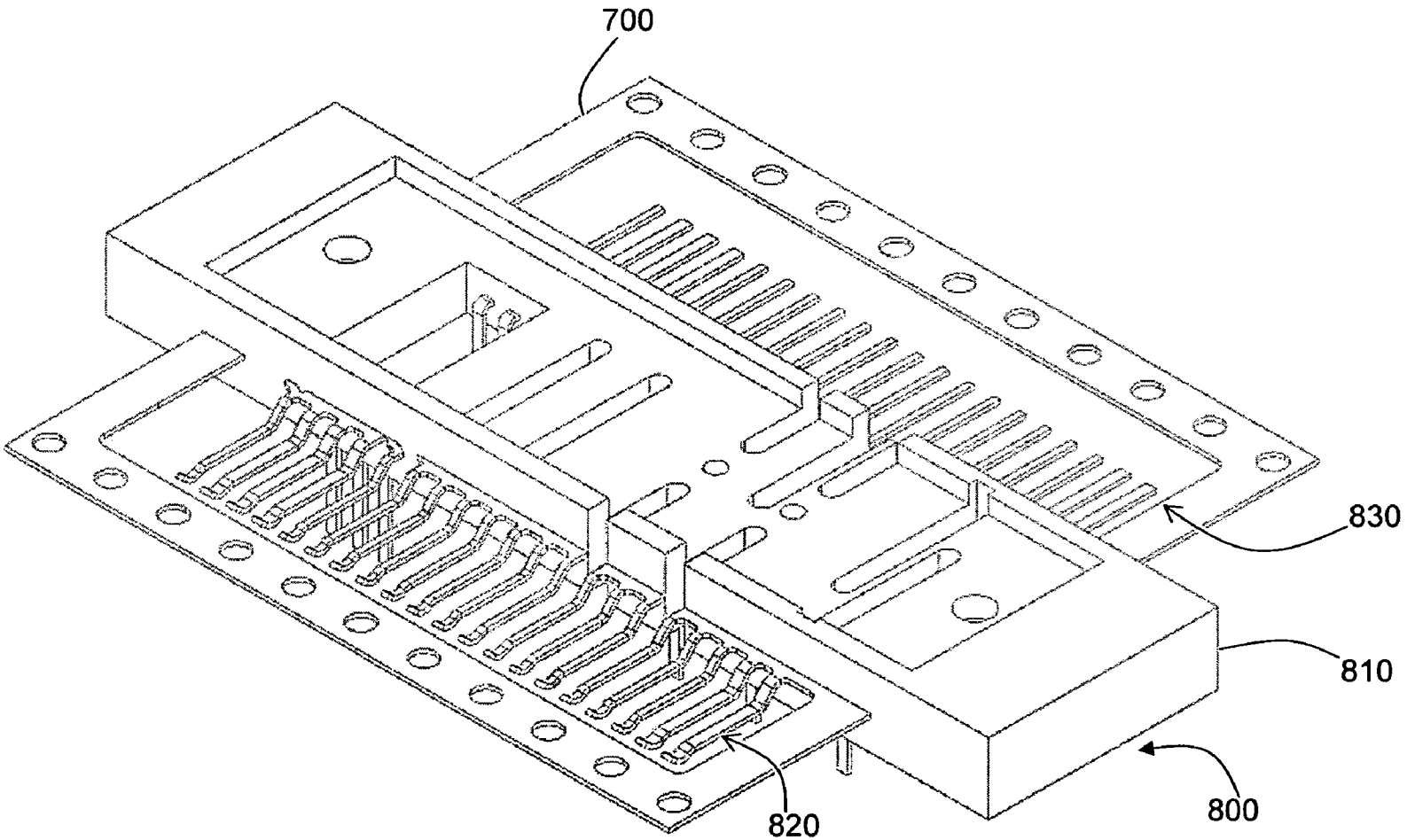
FIG. 8 is a sketch of a wafer incorporating the lead frame of FIG. 7.
Figure 9A:
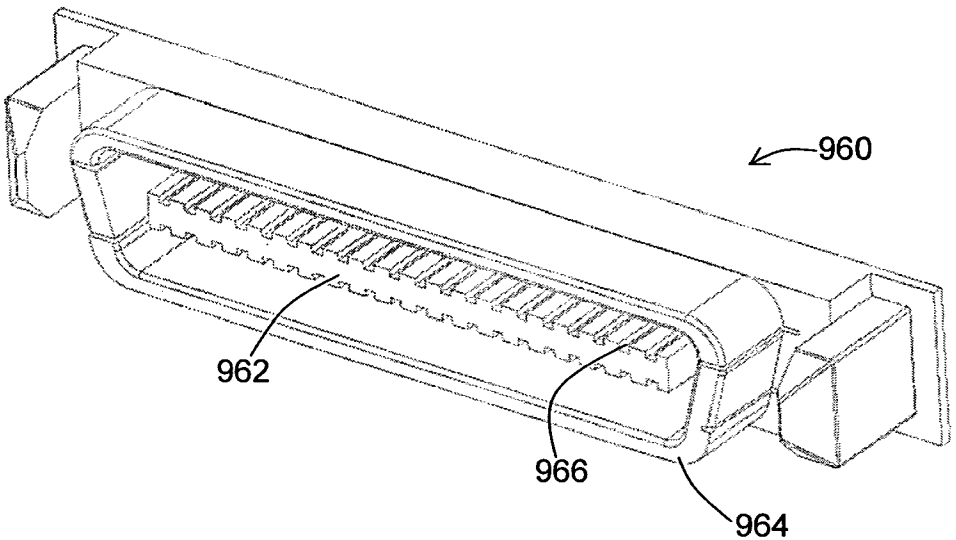
FIGS. 9A and 9B are sketches of caps used in the adapter of FIG. 1.
Figure 9B:
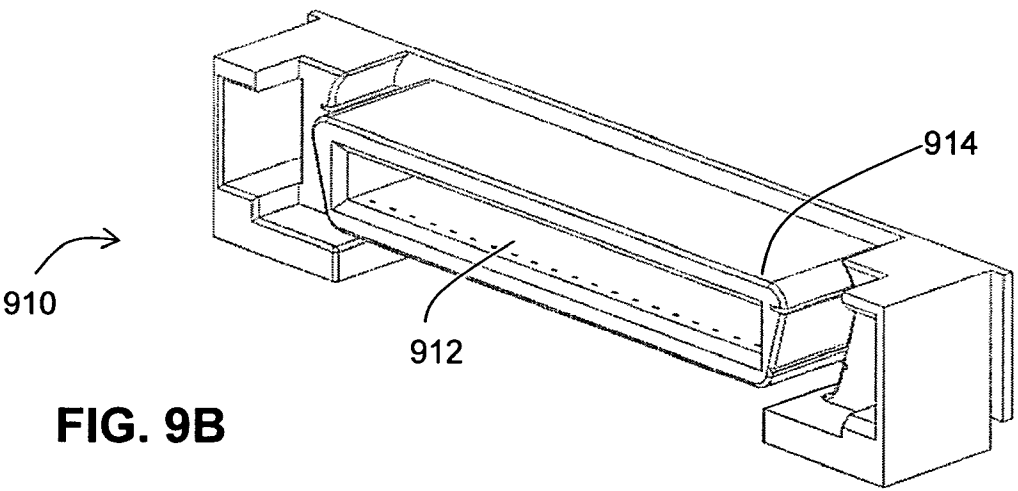

FIG. 8 illustrates a wafer 800 made by molding insulating housing 810 around portions of the conductive elements of lead frame 700. In the illustrated embodiment, the housing for wafer 800 is made of insulating material. However, in some embodiments, lossy materials or other suitable materials may be incorporated into housing 810. Further, the specific mechanism by which housing 810 is formed is not a limitation of the invention. In some embodiments, housing 810 may be formed separate from lead frame 700 and the conductive elements from lead frame 700 may be inserted into housing 810 after it is formed. Accordingly, the specific mechanism by which wafer 800 is formed is not critical to the invention, and any suitable construction techniques may be employed to make wafer 800.

Regardless of the technique used to construct wafer 800, once wafer 800 is formed, wafers 400 and 800 may be placed side-by-side with perpendicular portions of the conductive elements of lead frame 700 of wafer 800 passing through openings in wafer 400.

Caps, such as caps 910 (FIG. 9B) and caps 960 (FIG. 9A), may then be attached to wafers 400 and 800 to form connectors on adapter 100. In the embodiment illustrated, caps 910 and 960 have complementary configurations. For example, cap 960 includes a projecting portion 962 adapted to fit within a recess 912 in cap 910. Cap 960 includes an outer wall 964 shaped to surround the outer wall 914 of cap 910. With this configuration, cap 910 may form a connector that may be inserted into a connector formed by cap 960, creating mechanically compatible connectors on opposite sides of adapter 100.

Caps 910 and 960 may also be configured to hold mating contacts extending from wafers 400 and 800. For example, cap 960 includes slots 966, which may be shaped to receive blade-shaped contacts such as are in row 430 and 830. Slots, such as slot 966, may be positioned to hold blade-shaped contacts, such as are in rows 430 and 830, in position to mate with beam-shaped contacts, such as are in rows 420 and 820. In adapter 100, caps 910 and 960 form connectors 110 and 120 on opposite sides of adapter 100. Accordingly, caps 910 and 960 do not directly mate when they are assembled into a adapter 100. Rather, connector 110 formed from cap 910 is shaped to mate with a connector in the form of connector 120. Similarly, connector 120, formed with cap 960, is shaped to mate with a connector in the form of connector 110. However, an adapter may be constructed with any suitable type or shape of connectors. Both the mating contacts extending from wafers 400 and 800 may be connected with shapes different than in the illustrated embodiment to create different forms of connectors. Similarly, caps 910 and 960 may be formed with other shapes to create connectors in forms other than the form illustrated.

Figure 10:
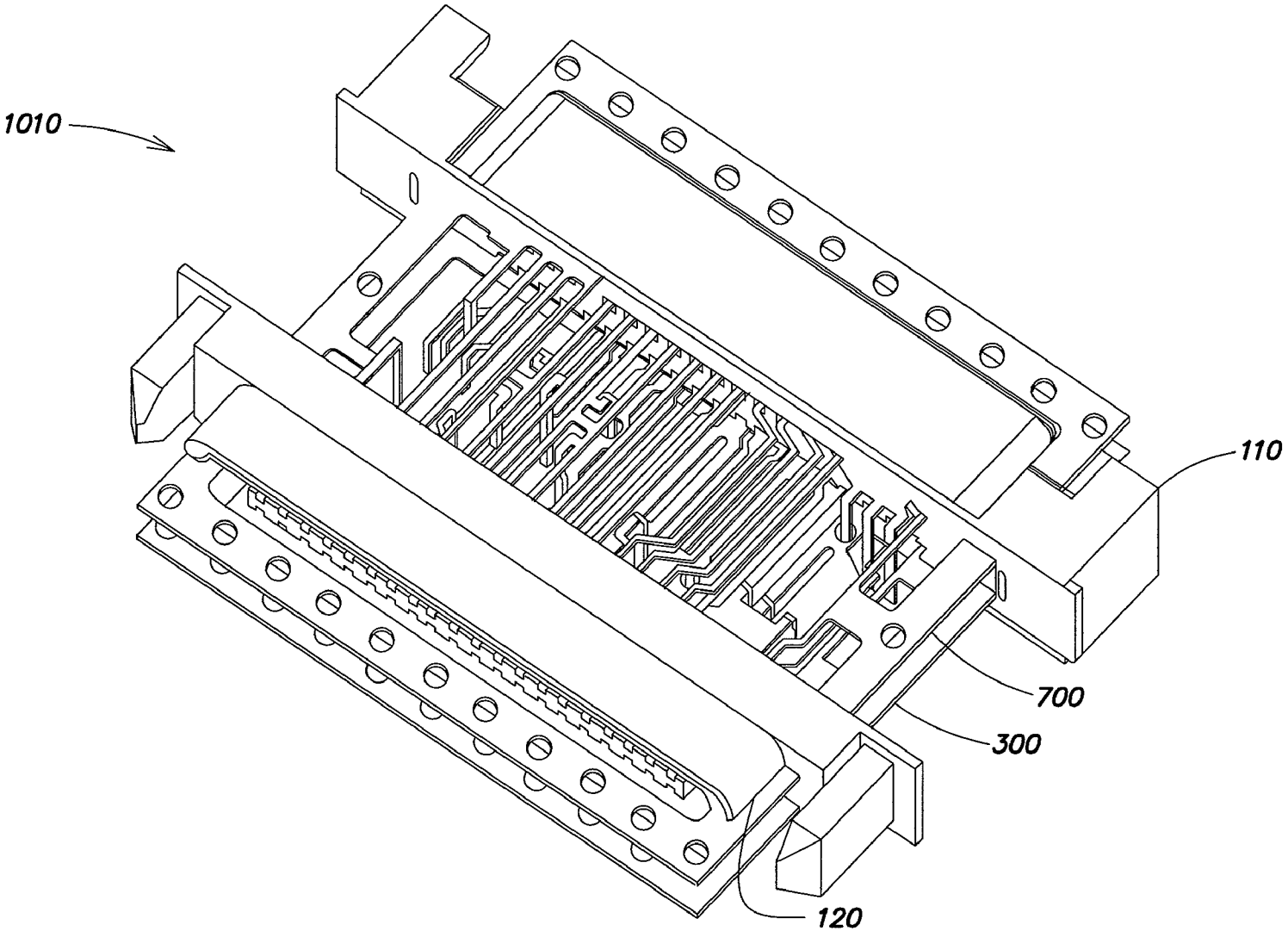
FIG. 10 is a sketch of the adapter of FIG. 1 with insulating portions shown cut away to reveal positions of the lead frames of FIGS. 3 and 7.

Turning to FIG. 10, the connector portions of adapter 100 are illustrated with the housings of wafers 400 and 800 cut away. In the view presented by FIG. 10, lead frames 700 and 300 are shown. As can be seen, the portions of the lead frames 300 and 700 positioned in the X-Y plane are aligned in parallel. Perpendicular portions of the conductive elements of lead frame 700 pass through holes in the conductive elements in lead frame 300 or otherwise pass through places in lead frame 300 not occupied by conductive elements of lead frame 300.

Though two lead frames are shown in FIG. 10, an adapter may be constructed with any number of lead frames. In the embodiments illustrated, each of the conductive elements has a segment running in a direction along an axis between connectors 110 and 120 (the Y direction). In addition, some of the conductive elements have portions that run transverse to that direction (the X direction or the Z direction). As described above, portions running in the Z direction allow a connection to a substrate. Portions running in the X direction allow positioning of the conductive elements in the X-Y plane such that portions from conductive element in one of the lead frames may readily pass through open spaces in other lead frames. However, neither the number of lead frames nor the configuration of conductive elements within a lead frame is a limitation of the invention.

Figure 11:
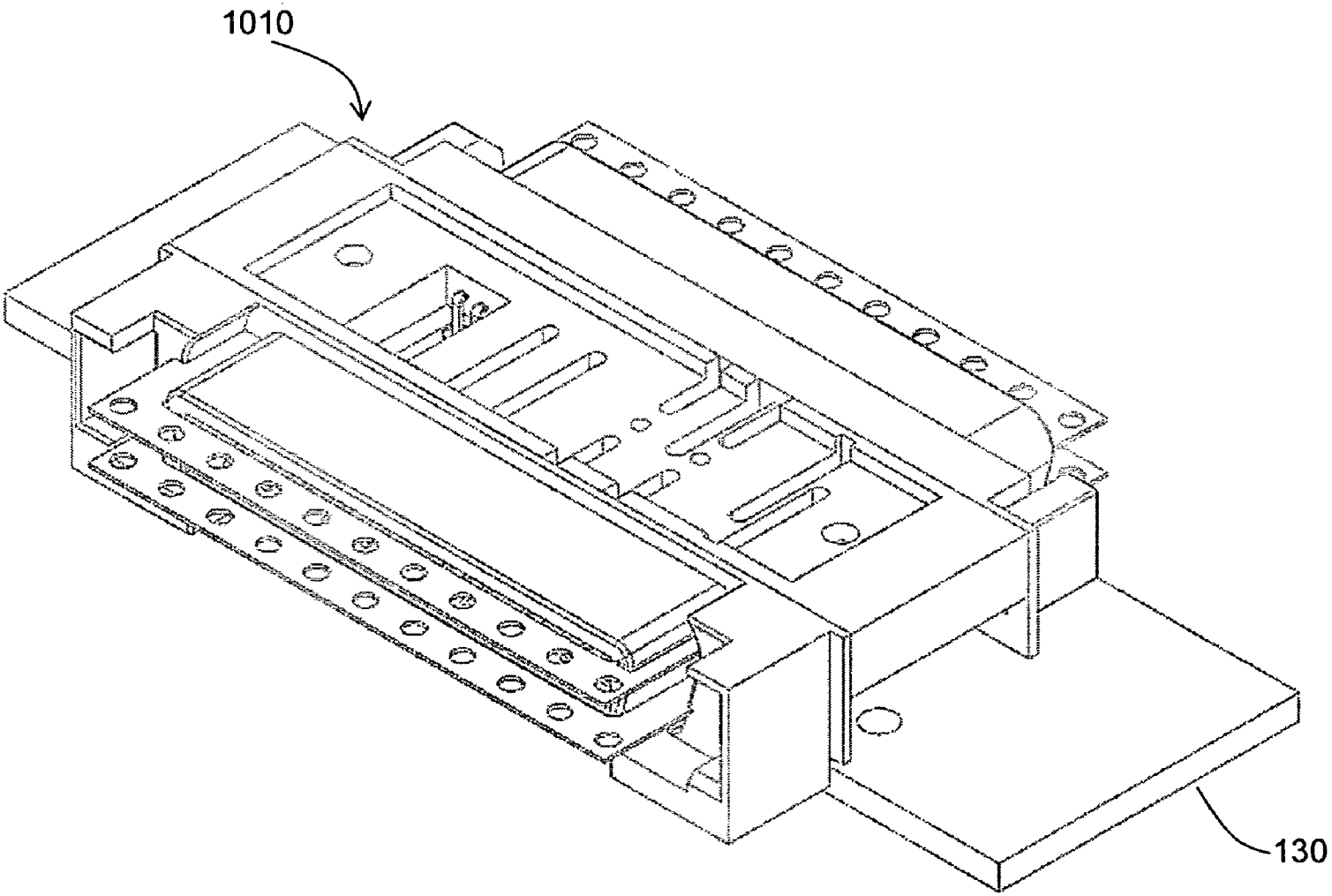
FIG. 11 is a sketch of the adapter of FIG. 1 with the mounting bracket removed.

FIG. 11 shows the connector sub-assembly 1010 of adapter 100 with the housings of wafers 400 and 800 visible. Connector sub-assembly 1010 may be mounted to printed circuit board 130 or other substrate. Known techniques for attaching a connector to a substrate may be used to mount connector sub-assembly 1010. Though, any suitable mounting technique may be used.

Figure 12:
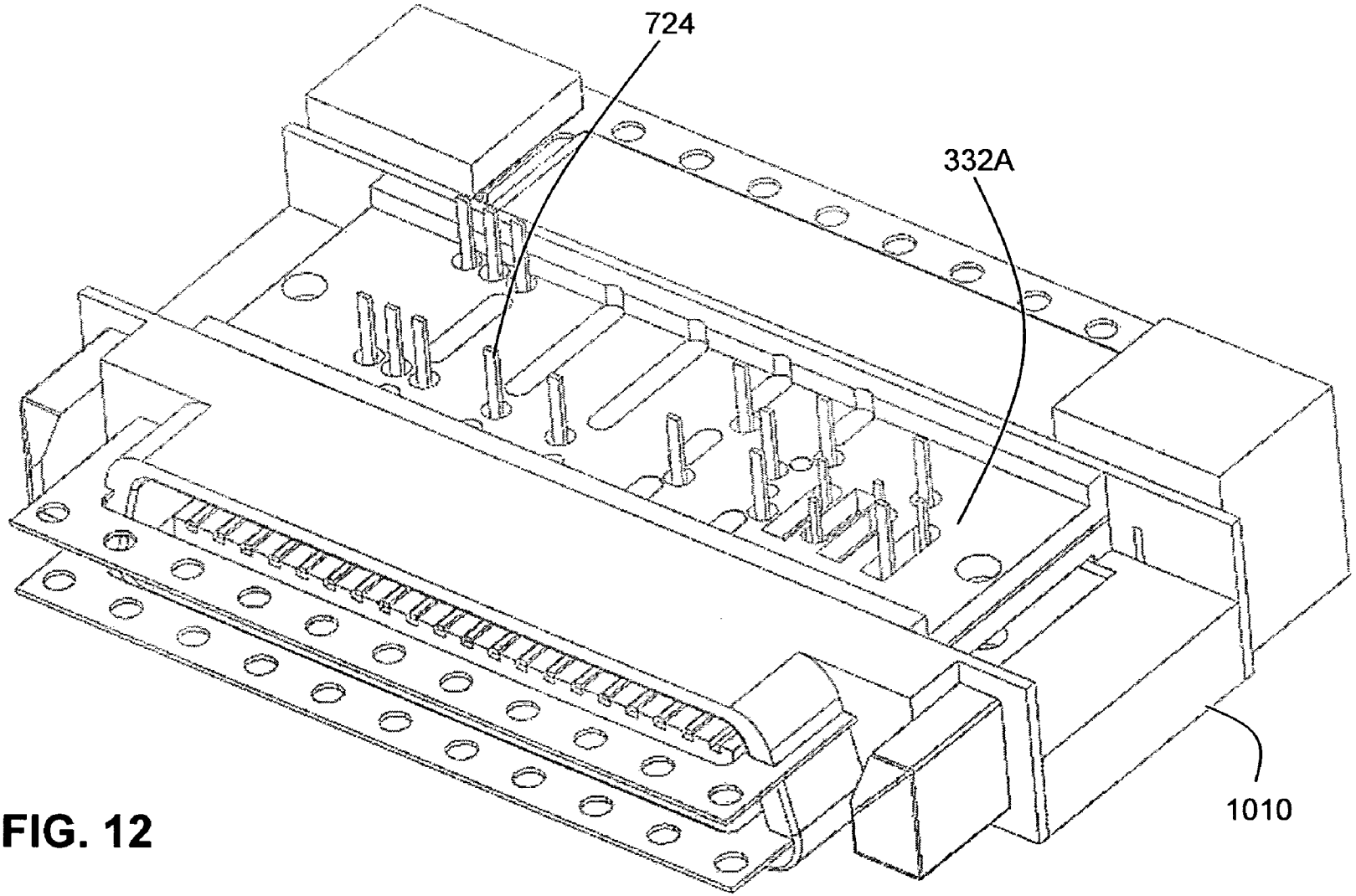
FIG. 12 is a bottom view of the adapter of FIG. 1 with the printed circuit board removed.

FIG. 12 shows a bottom view of connector sub-assembly 1010. As can be seen in the illustration of FIG. 12, perpendicular portions extending from both wafer 400 and 800 extend through the lower surface of connector sub-assembly 1010 where they can engage printed circuit board 130. For example, perpendicular portions 724 from wafer 800 and perpendicular portion 332A from wafer 400 both project from the lower surface of connector sub-assembly 1010 and are therefore positioned to engage printed circuit board 130. Other perpendicular portions from both wafers 400 and 800 may project through the lower surface of connector sub-assembly 1010 and may likewise engage printed circuit board 130.

Figure 13:
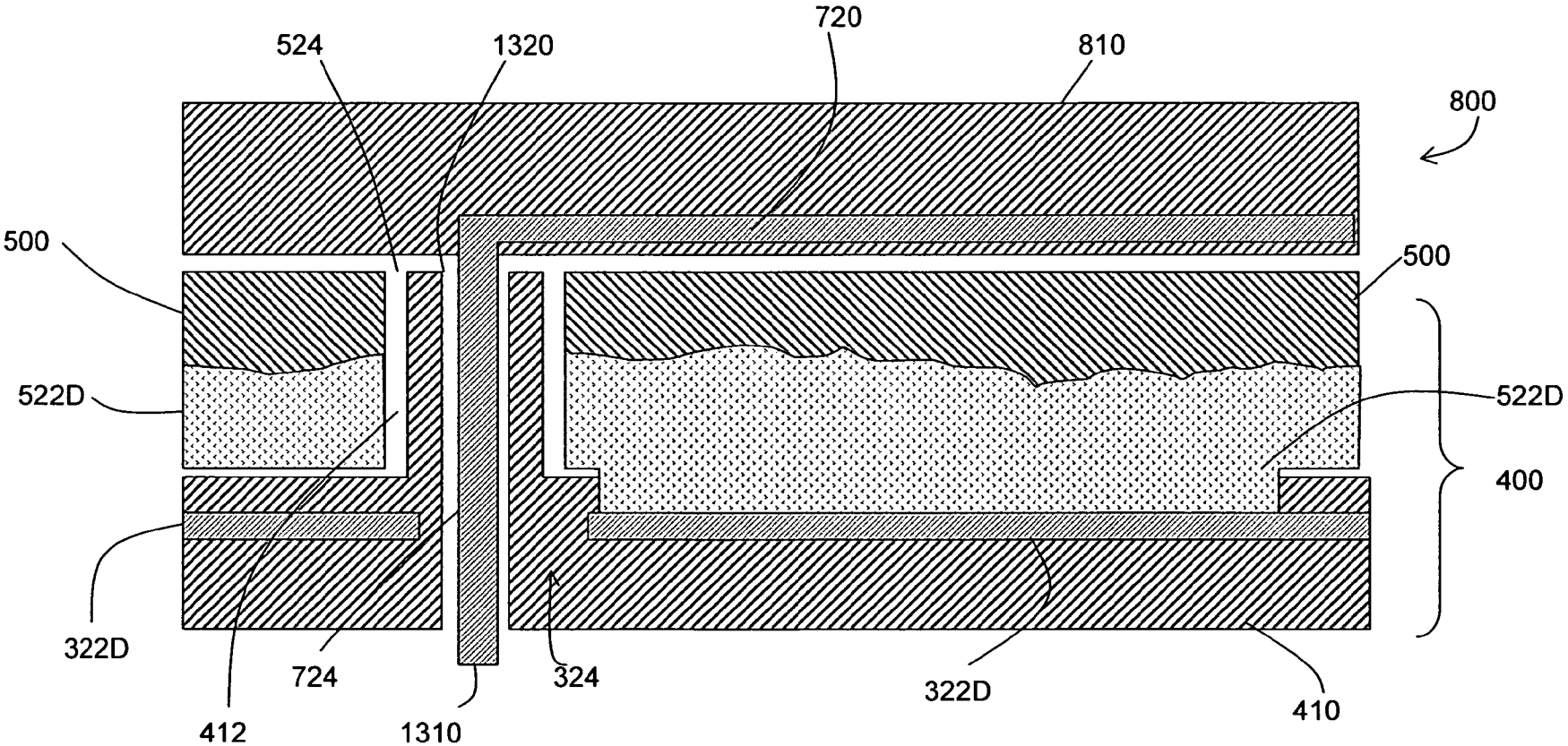
FIG. 13 is a sketch of a cross-section through a portion of the wafers of FIGS. 6 and 8.

FIG. 13 shows additional detail of the construction of connector sub-assembly 1010, allowing perpendicular portions from wafer 800 to pass through wafer 400. In the cross-section of FIG. 13, wafer 400 is shown with a housing formed by insulating portion 410 and lossy insert 500. The cross-section of FIG. 13 is taken through ground conductor 322D, which is also visible in FIG. 13. The region depicted by FIG. 13 includes hole 324 in ground conductor 322D.

The projection 412 from insulating housing 410 extends above hole 324. When lossy insert 500 is placed into insulating housing 410, a projection, such as projection 522D of lossy material may contact or otherwise be adjacent to ground conductor 322D at one or more locations. However, projection 412 electrically insulates passage 1320 through wafer 400 from the lossy material of lossy insert 500.

When wafer 800 is placed side-by-side with wafer 400, projecting portion 724 may pass through passage 1320 without contacting the lossy material in region 522D. In this way, conductive member 720 has a contact tail 1310 that may engage circuit board 130 or other substrate without being shorted to other conductive elements through lossy material of lossy insert 500.

Having thus described several aspects of at least one embodiment of this invention, it is to be appreciated various alterations, modifications, and improvements will readily occur to those skilled in the art.

As one example, a connector designed to carry differential signals was used to illustrate selective placement of lossy material to achieve a desired level of crosstalk reduction at an acceptable level of attenuation to signals.

Further, although many inventive aspects are shown and described with reference to an adapter, it should be appreciated that the present invention is not limited in this regard, as the inventive concepts may be included in other types of electrical connectors, such as backplane connectors, cable connectors, stacking connectors, mezzanine connectors, or chip sockets.

As a further example, only low speed signal conductors are shown routed in the Z-direction. Any conductor may be routed in the Z-direction.

Such alterations, modifications, and improvements are intended to be part of this disclosure, and are intended to be within the spirit and scope of the invention. Accordingly, the foregoing description and drawings are by way of example only.

What is claimed is:

1. An electrical connector, comprising:

a first subassembly, comprising:

a first housing having at least one hole extending through the first housing; and a first plurality of conductive members, each of the first plurality of conductive members having a portion disposed within the first housing in a first plane, wherein the hole is disposed perpendicular to the first plane; and a second subassembly, comprising:

a second housing; and a second plurality of conductive members, each of the second plurality of conductive members having a portion disposed within the second housing in a second plane, the second plane being parallel to the first plane, wherein at least one of the second plurality of conductive members has a second portion extending from the second housing and through the at least one hole.

2. The electrical connector of claim 1, wherein:

each of the first plurality of conductive members has a mating contact portion extending from the first housing along a first line coplanar with the first plane; and each of the second plurality of conductive members has a mating contact portion extending from the second housing along a second line coplanar with the second plane.

3. The electrical connector of claim 2, further comprising a member engaged to the first housing and the second housing, the member having a cavity with the mating contact portions of the first plurality of conductive members and the second plurality of conductive members being positioned in the cavity.

4. The electrical connector of claim 3, wherein:

each of at least a portion of the first plurality of conductive members has a second mating contact portion extending from the first housing along a third line coplanar with the first plane; and each of at least a portion of the second plurality of conductive members has a second mating contact portion extending from the second housing along a fourth line coplanar with the second plane.

5. The electrical connector of claim 4, further comprising a second member engaged to the first housing and the second housing, the second member having a cavity with the second mating contact portions of the first plurality of conductive members and the second plurality of conductive members being positioned in the cavity.

6. The electrical connector of claim 5 in combination with a printed circuit board, wherein the second portion of each of the at least one of the second plurality of conductive members is secured to the printed circuit board.

7. The electrical connector of claim 1 in combination with a printed circuit board, wherein the second portion of each of the at least one of the second plurality of conductive members is secured to the printed circuit board.

8. The electrical connector of claim 1, wherein a first portion of the first housing comprises an insulating material and a second portion of the second housing comprises a lossy conductive material.

9. The electrical connector of claim 8, wherein the first plurality of conductive members comprises a plurality of pairs of signal conductors and a plurality of ground conductors, each of the plurality of ground conductors being adjacent to a pair of the plurality of pairs of signal conductors and being wider than a conductor of a pair of the plurality of pairs of signal conductors, wherein a hole of the at least one holes passes through a ground conductor of the plurality of ground conductors.

10. An electrical connector, comprising a plurality of subassemblies, including a first subassembly and a second subassembly:

the first subassembly, comprising:

a first housing;

a first plurality of conductive members extending in a first plane, each of the first plurality of conductive members having a portion embedded in the first housing;

the second subassembly, comprising:

a second housing;

a second plurality of conductive members extending in a second plane, parallel to the first plane, each of the second plurality of conductive members having a portion embedded in the second housing, at least one of the second plurality of conductive members having a portion extending from the second housing and passing through the first housing perpendicular to the first plane and the second plane.

11. An electrical connector, comprising a plurality of subassemblies, including a first subassembly and a second subassembly:

the first subassembly, comprising:

a first housing, comprising:

a first piece, comprising a first insulating portion and at least one region of insulating material being integrally formed with the first insulating portion, each region of the at least one region of insulating material having a hole therethrough; and a second piece, the second piece comprising a region of lossy material, the region of lossy material having at least one opening therein, each of the at least one openings having a region of the at least one region of insulating material extending therethrough;

a first plurality of conductive members, each of the first plurality of conductive members having a portion embedded in the first insulating portion of the first housing, the second subassembly, comprising:

a second housing;

a second plurality of conductive members, each of the second plurality of conductive members having a portion embedded in the second housing, at least one of the second plurality of conductive members having a portion extending from the second housing and passing through the hole of a region of the at least one region of insulating material.

12. The electrical connector of claim 10, wherein:

each of the first plurality of conductive members and second plurality of conductive members has a first end and a second end;

at least a portion of the first plurality of conductive members have mating contact portions on the first end and the second end, the mating contact portions extending from opposite sides of the first housing;

at least a portion of the second plurality of conductive members have mating contact portions on the first end and the second end, the mating contact portions extending from opposite sides of the second housing.

13. An electrical connector, comprising a plurality of subassemblies, including a first subassembly and a second subassembly:

the first subassembly, comprising:

a first plurality of conductive members, each of the first plurality of conductive members having a first end and a second end, at least a first subset of the first plurality of conductive members having a mating contact at each of the first end and the second end, with the mating contacts at the first ends being aligned in a first row and the mating contacts at the second ends being aligned in a second row, parallel to the first row; and a first insulating housing molded around at least a portion of each of the first plurality of conductive members;

the second subassembly, comprising:

a second plurality of conductive members, each of the second plurality of conductive members having a first end and a second end, at least a second subset of the second plurality of conductive members having a mating contact at each of the first end and the second end, with the mating contacts at the first ends being aligned in a third row and the mating contacts at the second ends being aligned in a fourth row, parallel to the third row;

a second insulating housing molded around at least a portion of each of the second plurality of conductive members; and a first insulating cap and a second insulating cap, the first row and the third row of mating contacts being positioned in the first cap and the second row and the fourth row of mating contacts being positioned in the second insulating cap.

14. The electrical connector of claim 13, wherein:

the first cap and the second cap each have a mating interface; and the mating interface of the first cap is complementary to the mating interface of the second cap.

15. The electrical of claim 14, wherein:

at least a subset of the first plurality of conductive members extend in a first plane from the first insulating cap to the second insulating cap;

a subset of the second plurality of conductive members extend in a second plane, parallel to the first plan from the first insulating cap to the second insulating cap;

each conductive member in a second subset of the second plurality of conductive members has a second end extending orthogonal to the second plane.

16. The electrical connector of claim 15, wherein the electrical connector is adapted and configured to form an adapter, the adapter further comprising a substrate having active circuitry and the second end of each conductive member in the second subset engages the substrate.

17. The electrical connector of claim 16, further comprising at least one lossy portion disposed between adjacent conductive members of the first plurality of conductive members.

18. The electrical connector of claim 13, further comprising a third plurality of conductive members, the third plurality of conductive members having portions parallel to the first row, the second row, the third row, and the fourth row.

* * * * *